US012492627B2

(12) United States Patent
Katterbauer et al.

(10) Patent No.: US 12,492,627 B2
(45) Date of Patent: Dec. 9, 2025

(54) INTELLIGENT UNDERBALANCED COILED TUBING DRILLING (UBCTD) GEOSTEERING OPERATIONS ADVISORY SYSTEM AND METHOD OF USE

(71) Applicant: SAUDI ARABIAN OIL COMPANY, Dhahran (SA)

(72) Inventors: Klemens Katterbauer, Dhahran (SA); Abdallah A. AlShehri, Dhahran (SA); Tareq Ghamdi, Dhahran (SA); Ali Abdallah Alyousef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/408,749

(22) Filed: Jan. 10, 2024

(65) Prior Publication Data

US 2025/0223899 A1 Jul. 10, 2025

(51) Int. Cl.
*E21B 44/00* (2006.01)
*E21B 47/022* (2012.01)

(52) U.S. Cl.
CPC ..... *E21B 44/00* (2013.01); *E21B 47/022* (2013.01); *E21B 2200/20* (2020.05); *E21B 2200/22* (2020.05)

(58) Field of Classification Search
CPC .... E21B 44/00; E21B 47/022; E21B 2200/20; E21B 2200/22; E21B 7/04; E21B 44/005; E21B 7/046; E21B 7/06
See application file for complete search history.

(56) References Cited

U.S. PATENT DOCUMENTS 8,121,971 B2 * 2/2012 Edwards ..... E21B 44/00 706/50
9,022,140 B2 * 5/2015 Marx ..... G06N 7/01 175/50

(Continued)

FOREIGN PATENT DOCUMENTS

WO 2020191360 A1 9/2020
WO 2022066742 A1 3/2022

OTHER PUBLICATIONS

A.R. Crabtree and W. Gavin, "Coiled tubing in sour environments: theory and practice," SPE Drilling & Completion, Mar. 2005, pp. 71-80, 10 pages.

(Continued)

*Primary Examiner* — Daniel P Stephenson
(74) *Attorney, Agent, or Firm* — Osha Bergman Watanabe & Burton LLP

(57) ABSTRACT

A method that may include obtaining well path data describing a first well path through one or more formations. The method may include obtaining first acquired drilling parameter data in real-time during a drilling operation for a predetermined well, wherein the drilling operation corresponds to the first well path. The method may include determining, by a computer processor, first predicted drilling data using a machine-learning model, the well path data, and the first acquired drilling parameter data, wherein the first predicted drilling data may include a predicted well path. The method may include determining whether the first predicted drilling data satisfies a predetermined criterion. The method may include determining, in response to determining that the first predicted drilling data fails to satisfy the predetermined criterion, an adjusted well path. The method may include transmitting a first command to update the drilling operation to implement the adjusted well path.

20 Claims, 5 Drawing Sheets

(56) References Cited

U.S. PATENT DOCUMENTS

| | | | | |
|---|---|---|---|---|
| 11,261,720 | B2 | 3/2022 | Aziz et al. | |
| 11,441,411 | B2 | 9/2022 | Venugopal et al. | |
| 11,636,352 | B2 | 4/2023 | Moreno Sierra et al. | |
| 2009/0132458 | A1* | 5/2009 | Edwards | G06N 5/025 702/9 |
| 2014/0116776 | A1* | 5/2014 | Marx | E21B 12/02 706/11 |
| 2014/0124265 | A1 | 5/2014 | Al-Yami et al. | |
| 2015/0218914 | A1* | 8/2015 | Marx | E21B 49/00 175/24 |
| 2016/0362971 | A1* | 12/2016 | Benson | E21B 44/00 |
| 2020/0011158 | A1* | 1/2020 | Xu | E21B 44/005 |
| 2020/0126386 | A1 | 4/2020 | Michalopulos et al. | |
| 2020/0174149 | A1* | 6/2020 | Thiruvenkatanathan | G01V 1/282 |
| 2021/0148213 | A1* | 5/2021 | Madasu | E21B 49/003 |
| 2021/0180439 | A1 | 6/2021 | Rawlinson et al. | |
| 2021/0348493 | A1 | 11/2021 | Aziz et al. | |
| 2022/0003108 | A1* | 1/2022 | Parak | E21B 44/00 |
| 2023/0221267 | A1 | 7/2023 | Moreno Sierra et al. | |
| 2023/0313666 | A1* | 10/2023 | Al Haji | E21B 44/00 175/24 |
| 2023/0313678 | A1* | 10/2023 | Saihati | E21B 45/00 175/50 |
| 2024/0035366 | A1* | 2/2024 | Walmsley | E21B 44/00 |
| 2025/0223899 | A1* | 7/2025 | Katterbauer | E21B 47/022 |

OTHER PUBLICATIONS

Gu et al., "Designing under-and near-balanced coiled-tubing drilling by use of computer simulations," SPE Drilling & Completion, Jun. 1999, pp. 102-108, 7 pages.

J. Misslebrook, "Technology Focus: Coiled Tubing Applications," Journal of Petroleum Technology, Jun. 2011, 1 page.

Mykytiw et al., "Mature-Field Rejuvenation of a Tight Gas Carbonate Reservoir Utilizing Coiled-Tubing Underbalanced-Drilling Techniques," SPE/IADC 113684, Jan. 28, 2008, 17 pages.

Pruitt et al., "Sajaa Underbalance Coiled Tubing Drilling Putting It All Together," Society of Petroleum Engineers, SPE 89644, Mar. 23, 2004, 13 pages.

* cited by examiner

INTELLIGENT UNDERBALANCED COILED TUBING DRILLING (UBCTD) GEOSTEERING OPERATIONS ADVISORY SYSTEM AND METHOD OF USE

BACKGROUND

Oil and gas well drilling paths may be affected by many variables in a drilling operation, such as drilling parameters, well parameters, and reservoir parameters. While well paths are often analyzed in the planning stages, unknown factors during a drilling operation may also contribute to dramatic changes in well paths that differ from earlier predictions.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments a method that includes obtaining well path data describing a first well path through one or more formations of a subsurface. The method includes obtaining first acquired drilling parameter data in real-time during a drilling operation for a predetermined well, wherein the drilling operation corresponds to the first well path. The method includes determining, by a computer processor, first predicted drilling data using a machine-learning model, the well path data, and the first acquired drilling parameter data, wherein the first predicted drilling data includes a predicted well path for the predetermined well. The method includes determining, by the computer processor, whether the first predicted drilling data satisfies a predetermined criterion. The method includes determining, by the computer processor and in response to determining that the first predicted drilling data fails to satisfy the predetermined criterion, an adjusted well path for the drilling operation, wherein the adjusted well path is different from the predicted well path. The method includes transmitting, by the computer processor to a drilling system, a first command to update the drilling operation to implement the adjusted well path.

This disclosure presents, in accordance with one or more embodiments a system that includes a drilling system including a plurality of sensors and a drill string including a drill bit, wherein the drilling system is coupled to a wellbore. The system includes a control system coupled to the drilling system, wherein the control system includes a computer processor, and the control system includes functionality for a method. The method includes obtaining well path data describing a first well path through one or more formations through a subsurface. The method includes obtaining first acquired drilling parameter data in real-time during a drilling operation for a predetermined well, wherein the drilling operation corresponds to the first well path associated with the wellbore. The method includes determining, using the computer processor, first predicted drilling data using a machine-learning model, the well path data, and the first acquired drilling parameter data, wherein the first predicted drilling data includes a predicted well path for the predetermined well. The method includes determining, by the computer processor, whether the first predicted drilling data satisfies a predetermined criterion. The method includes determining, by the computer processor and in response to determining that the first predicted drilling data fails to satisfy the predetermined criterion, an adjusted well path for the drilling operation, wherein the adjusted well path is different from the predicted well path. The method includes transmitting, by the computer processor to the drilling system, a first command to update the drilling operation to implement the adjusted well path.

In light of the structure and functions described above, embodiments disclosed herein may include respective means adapted to carry out various steps and functions defined above in accordance with one or more aspects and any one of the embodiments of one or more aspect described herein.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
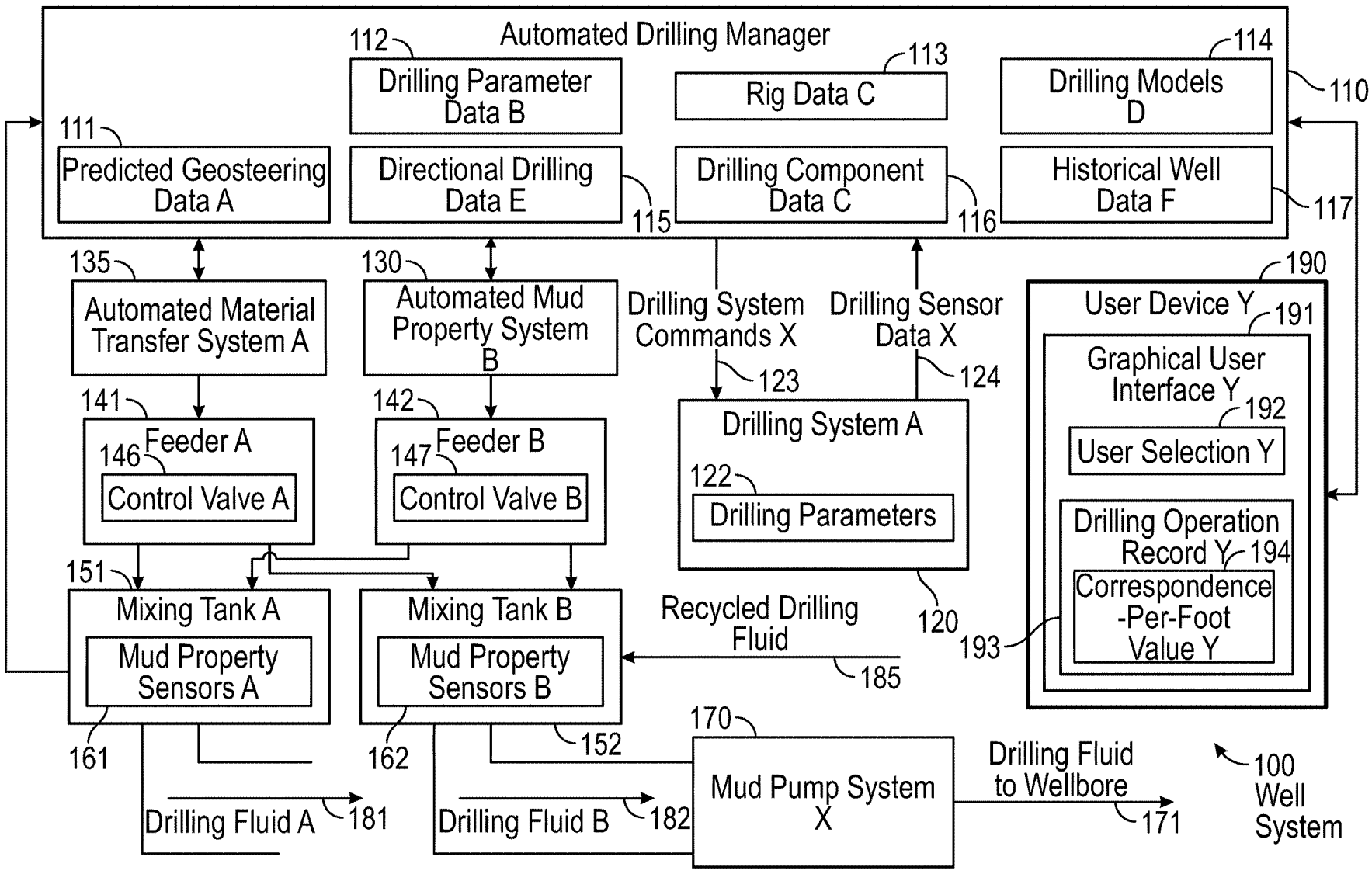
FIGS. 1 and 2 show systems in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. Measured depth (MD) is the length of the wellbore. True vertical depth (TVD) is the vertical distance from a point in the well at a location of interest to a reference point on the surface.

A producing zone of a reservoir is the zone containing hydrocarbons that are economically producible. The reservoir is marked with geological markers to drill the wellbore into the producing zone for optimal production and reservoir coverage. In some long, horizontal wellbores, the wellbores may be drilled out of the producing zone. Steering the wellbore back into the producing zone takes time, depending on the angle of the geological layers.

Geosteering is used to steer the wellbore based on geological and geophysical measurements to an optimal location to access the wellbore and to keep the wellbore within a producing zone of the reservoir. Furthermore, geosteering is used to adjust the position of a wellbore, i.e., inclination and azimuth angles, to reach a producing zone. The position of the wellbore is adjusted based on the geological and geophysical data gathered while drilling.

Underbalanced Coiled Tubing Drilling (UBCTD) technology is used to develop mature and depleted reservoirs. Underbalanced drilling (UBD) involves drilling while keeping the pressure of the wellbore lower than the static pressure of the formation being drilled. Drilling with few geological markers makes it challenging to keep the wellbore within the target producing zone for optimum production and reservoir coverage. Traditional UBCTD practice uses measurement while drilling (MWD) technology such as gamma ray (GR) analysis and cuttings analysis at surface. Using MWD technology means that the sensors are about 40 ft behind the bit, therefore when the sensor is registering out of zone, the bit has already drilled that distance out of the reservoir. Accordingly, there exists a need for an advisory system for UBCTD to advise and guide the operator of the UBCTD.

In general, embodiments of the disclosure include systems and methods for determining changes in oil and gas well drilling paths data in real-time during a drilling operation. In some embodiments, drilling path data and predicted geosteering data (e.g., the position of a wellbore, including numerical three-dimensional matrices of coordinates, inclination and azimuth angles of drilling a portion of a wellbore) may be analyzed in real-time, e.g., using a user device or an automated drilling manager, in order to optimize the performance of the drilling operation. In particular, well path data may quantify the drilling performance (e.g., remaining within the target producing zone) when drilling long sections of a well path. A drilling operation may require redirecting a geosteerable drill bit in a drill string to complete a well path. Rather than calculating correspondence to a predetermined well path (correspondence-per-length or accuracy) after a particular drilling run, decisions may be made automatically in real-time to select the best drilling path data (e.g., the position of the wellbore) and quantify changes with respect to any predetermined criterion (e.g., target producing zone for a particular section). For example, the method may determine an adjusted well path if a first acquired drilling parameter data is worse than the predetermined correspondence-per-length rate (poor accuracy.) Likewise, the method may determine an adjusted well path if the predicted drill path data is worse than the predetermined correspondence-per-length rate.

Furthermore, some embodiments enable benchmarking current drilling paths with respect to historical performance at similar wells. For example, historical wells may be selected based on historical well data (e.g., historical well data F (117)) that describes geological formations, hole sizes, location of wells, type of drilling mode for the respective well, and bit types used. Historical well data may be obtained from wells that have been drilled nearby. In general, stronger correlations to planned wells may result with historical well data obtained closer in distance to the planned well. A planned or predetermined well may use historical well data from one or more wells that are offset a predetermined distance from the predetermined well.

Drilling performance may be assessed during a drilling run (e.g., notifying drillers of a non-correspondence to a predetermined well path, which is a way of saying the well path deviated from the desired, or planned, or targeted well path.) Real-time results may be compared with target drilling paths as such.

Accordingly, drilling path data may be used to determine whether to continue drilling with a selected set of drilling parameters or to revise the parameters (e.g., geosteering data) to redirect a drill bit or other drilling components. By accounting for bit position in real time, a user may monitor changes in path trends in comparison with estimated paths and select different drilling parameters based on the path trends.

In general, embodiments of the disclosure include systems and methods for predicting UBCTD parameters for a target well using a hybrid machine-learning architecture. The target well may be an oil and/or gas well within a particular reservoir region that is producing hydrocarbons. In particular, the hybrid machine-learning architecture may include multiple machine-learning models coupled together, such as two k-nearest neighbor (k-NN) models and an artificial neural network that predict geosteering data for the target well. More specifically, measured well data may correspond to a wellbore path of a well.

In some embodiments, one k-NN model determines predicted geosteering data for the target well using path data acquired from sensors for one or more wells. Likewise, another k-NN model may determine predicted geosteering data for the current well using path data acquired from sensors for a portion of the current well that has already been drilled. After training both k-NN models to predict data for the target well, an artificial neural network may be trained that uses acquired path data from other wells, acquired pressure data from other wells, acquired temperature data from other wells, acquired pressure gradient data from other wells, predicted pressure data for the target well, and predicted pressure gradient data for the target well. Based on these different data inputs, the artificial neural network may determine predicted path data for the target well. From this predicted path data, various predicted drilling parameters may be determined accordingly, such as rate of penetration, weight on bit, mud weight, well length and trajectory, net-to-gross ratio, formation intersections, etc., of the target well.

In some embodiments, a time window is used to prepare acquired data for input to the hybrid machine-learning architecture. To predict path data at the target well, relevant time series data may be collected based on the time window. In order words, real-time predictions at a target well may require a simultaneous or near simultaneous collection of acquired data at different locations along the wellbore path. Thus, the time window may specify a particular period of time for data acquisition, such as a particular minute, hour, or day that defines the starting time and the ending time for collecting well data throughout a wellbore path for inputs to the hybrid machine-learning architecture. In some embodiments, output path values from an artificial neural network may be averaged (e.g., to obtain a mean value) over the acquisition time window in order to obtain a smoother flow rate signal and better estimates of predicted flow rate data for the target well.

Furthermore, some embodiments provide real-time path correspondence that may be used in the model or models. Thus, the hybrid machine-learning architecture may provide real-time insights regarding the as-drilled wellbore path and correspondence of the drilled path with the planned path of the well using path data in portions of the wellbore that have already been drilled. Thus, some embodiments may access frequently collected data throughout the drilling of the wellbore. By using well path data sources, real-time path information may be obtained for a well drilling operation, such as information on changing correspondence of the measured path for different portions of the wellbore path. For example, changes in the geology of a reservoir may result in switching drilling parameters for the currently-drilled well and/or the target well.

Turning to FIG. 1, FIG. 1 shows a schematic diagram in accordance with one or more embodiments. As shown in FIG. 1, FIG. 1 illustrates a well system 100 that may include an automated drilling manager (e.g., automated drilling manager 110) coupled to one or more user devices (e.g., user device Y 190), a drilling system (e.g., drilling system A 120), a mud pump system (e.g., mud pump system X 170), an automated material transfer system (e.g., automated material transfer system A 135), an automated mud property system (e.g., automated mud property system B 130), and various drilling fluid processing components. For example, drilling fluid processing equipment may include one or more feeders (e.g., feeder A 141, feeder B 142), one or more control valves (e.g., control valve A 146, control valve B 147), one or more mixing tanks (e.g., mixing tank A 151, mixing tank B 152), and a solid removal system. An automated mud property system may include hardware and/or software that includes functionality for monitoring and/or controlling various chemical components used to produce drilling fluid. Likewise, the automated drilling manager may include hardware and/or software for monitoring and/or controlling one or more drilling operations performed by a drilling system. For example, a drilling operation may have many drilling runs (or drill runs), thus a first drilling run, second drilling run, a third drilling run, etc. A drilling run may refer to a portion of a drilling operation where a bottomhole assembly may enter a wellbore for drilling until the bottomhole assembly is removed from the wellbore. The drilling runs each drills some part of a well path. The first drill run may drill a first well path. A drilling operation to drill the first well path is a first well path operation.

With respect to the drilling system, drilling fluid may circulate through a drill string for continuous drilling, e.g., drilling fluid A 181 and drilling fluid B 182 as shown in FIG. 1, in order to circulate through a wellbore (e.g., drilling fluid to wellbore 171). The drilling fluid may be circulated through drill pipe or through coiled tubing. In both cases the drill bit is connected to the distal end, e.g., the downhole end of the drill pipe or the coiled tubing. In the use of coiled tubing, a coiled tubing drilling system is used. In particular, the ability of the drilling fluid to carry drilled cuttings from a wellbore may be governed by several factors that relate to various drilling fluid properties (e.g., mud rheology, mud weight, etc.) and various drilling operation parameters (e.g., drilling parameters 122) such as drill pipe rotary speed (RPM), pipe eccentricity (i.e., axial location of the drill pipe), hole inclination angle, and rate of penetration (ROP). Likewise, used drilling fluid from a wellbore may be passed through a solid removal system prior to entering a mixing tank or being sent to a mud pump system. More specifically, a solid removal system may include equipment and other hardware for removing particulate solids, such as drill cuttings and coarse aggregates, from used drilling fluid in order to recycle drilling fluid (e.g., recycled drilling fluid 185). For more information on drilling systems, see FIG. 2 and the accompanying description below.

Furthermore, drilling fluid data (such as density data, lost circulation material (LCM) data, and mud velocity data) may correspond to different physical qualities associated with drilling mud, such as specific gravity values (also referred to as mud weight or mud density), viscosity levels, pH levels, rheological values such as flow rates, temperature values, resistivity values, mud mixture weights, mud particle sizes, mud pressures, mud velocities, and various other attributes that affect the role of drilling fluid in a wellbore. For example, a drilling fluid property may be selected by a user device to have a desired predetermined rheological value, which may include a range of acceptable values, a specific threshold value that should be exceeded, a precise scalar quantity, etc. As such, an automated drilling manager or another control system may obtain sensor data from various mud property sensors (e.g., mud property sensor A 161, mud property sensor B 162) regarding various drilling fluid property parameters. Examples of mud property sensors include pH sensors, density sensors, rheological sensors, volume sensors, weight sensors, flow meters, such as an ES flow sensor, etc. Likewise, sensor data may refer to both raw sensor measurements and/or processed sensor data associated with one or more drilling fluid properties.

With respect to mud pump systems, a mud pump system (e.g., mud pump system X 170) may include hardware and software with functionality for supplying drilling fluid to a wellbore at one or more predetermined pressures and/or at one or more predetermined flow rates. For example, a mud pump system may include one or more displacement pumps that inject the drilling fluid into a wellbore. Likewise, a mud pump system may include a pump controller that includes hardware and/or software for adjusting local flow rates and pump pressures, e.g., in response to a command from an automated drilling manager or other control system. For example, a mud pump system may include one or more communication interfaces and/or memory for transmitting and/or obtaining data over a well network. A mud pump system may also obtain and/or store sensor data from one or more sensors coupled to a wellbore regarding one or more pump operations. While a mud pump system may correspond to a single pump, in some embodiments, a mud pump system may correspond to multiple pumps.

With respect to mixing tanks, a mixing tank may be a container or other type of receptacle (e.g., a mud pit) for mixing various liquids, fresh mud, recycled mud (e.g., recycled drilling fluid 185), additives, and/or other chemicals to produce a particular type of drilling fluid (e.g., drilling fluid A 181, drilling fluid B 182). For example, a mixing tank may be coupled to one or more mud supply tanks, one or more additive supply tanks, one or more dry/wet feeders (e.g., feeder A 141, feeder B 142), and one or more control valves (e.g., control valve A 146, control valve B 147) for managing the mixing of chemicals within a respective mixing tank. Control valves may be used to meter chemical inputs into a mixing tank, as well as release drilling fluid into a mixing tank. Likewise, a mixing tank may include and/or be coupled to various types of drilling fluid equipment not shown in FIG. 1, such as various mud lines, liquid supply lines, and/or other mixing equipment.

In some embodiments, a well system includes an automated material transfer system (e.g., automated material transfer system A 135). In particular, an automated material transfer system may be a control system with functionality for managing supplies of bulk powder and other inputs for producing a preliminary mud mixture. For example, an automated material transfer system may include a pneumatic, conveyer belt or a screw-type transfer system (e.g., using a screw pump) that transports material from a supply tank upon a command from a sensor-mediated response. Thus, the automated material transfer system may monitor a mixing tank using weight sensors and/or volume sensors to meter a predetermined amount of bulk powder to a selected mixing tank.

Likewise, a well system may also include an automated mud property system (e.g., automated mud property system B 130) to control the supply of various additives to a mixing tank. In some embodiments, for example, an automated mud property system may include hardware and/or software with functionality for automatically supplying and/or mixing weighting agents, buffering agents, rheological modifiers, and/or other additives until a mud mixture matches and/or satisfies one or more desired drilling fluid properties. Examples of weighting agents may include barite, hematite, calcium carbonate, siderite, etc. A buffering agent may be a pH buffering agent that causes a mud mixture to resist changes in PH levels. For example, a buffering agent may include water, a weak acid (or weak base) and salt of the weak acid (or a salt of weak base). Rheological modifiers may include drilling fluid additives that adjust one or more flow properties of a drilling fluid. One type of rheological modifier is a viscosifier, which may be an additive with functionality for providing thermal stability, hole-cleaning, shear-thinning, improving carrying capacity as well as modifying other attributes of a drilling fluid. Examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

In some embodiments, an automated drilling manager include hardware and/or software with functionality for determining predicted geosteering data relating to a drilling operation. Drilling geosteering data for a hydrocarbon well may be affected by categories such as drilling parameters, well parameters, and reservoir parameters. Drilling parameters include, amongst others, the hole diameter and depth as well as the longest casing string's length, rate of penetration (ROP), weight on bit (WOB), mud weight, and other associated parameters. The drilling parameters play a crucial role in determining the formation and provide implicit information on the geomechanics of the formation, and indirectly on its porosity. Well parameters incorporate the production performance, such as gas production, the well length and trajectory, net-to-gross ratio, formation intersections, true vertical depth (TVD) and measured depth (MD) in addition to completion parameters. Reservoir parameters are sourced from the reservoir environment, which may include reservoir geology, bio-steering derived information, as well as rock cuttings provided information. Multiple other parameters may contribute to well paths, such as rig data (e.g., rig data C 113), directional drilling data (e.g., directional drilling data E 115), and various fixed components data (e.g., drilling component data C 116).

Furthermore, predicted geosteering data may describe an advance path estimate of a drilling operation at a particular formation. In some embodiments, the predicted geosteering data describes changes in real-time to paths relating to an ongoing drilling operation. A drilling operation may commence with a planned wellbore path to follow. The planned wellbore path may include predetermined acceptance criteria, i.e., measurement tolerances, to which the measured drilled wellbore is to correspond. The predetermined acceptance criteria may include tolerances on numerical three-dimensional matrices of coordinates and azimuth and inclination angles.

Real-time data from the automated drilling manager may be used to determine the actual measured drilled wellbore path along a portion of the drilled wellbore. The well drilling plan may include a desired, targeted, or planned path of the well. The planned path may be quantified with orthogonal coordinates as well as azimuth and inclination angles. Each of the coordinates and angles may have a tolerance, e.g., coordinate x±tolerance a, coordinate y±tolerance b, and coordinate z±tolerance c. The drilling of the well would then aim to follow the planned path and to remain within the tolerances of the planned path. The tolerances may be referred to as predetermined correspondence-per-length, where each tolerance may be referred to as a predetermined criterion. Examples of the predetermined correspondence-per-length may include a planned correspondence-per-length, i.e., a targeted correspondence-per-length.

A determination may be made regarding compliance of the measured path with the planned path. The measured path may be compared to the predetermined acceptance criteria (e.g., a coordinates matrix and angles tolerances) and an action may be taken in response to the comparing. For example, a comparison of the measured path may show the measured path falling within the tolerances of the planned path. The comparison may be quantified as a correspondence-per-length such as a correspondence-per-foot of the measured path with the tolerances of the planned path. Correspondence-per-foot may be measured in real-time. Measured correspondence-per-length may be referred to as an actual correspondence-per-length. A quantitative value may be determined by comparing the actual correspondence-per-length with the predetermined correspondence-per-length. The quantitative value may be referred to as a success factor. The success factor may a categorical variable, i.e., a categorical success factor. Using numerical values to describe a success factor may be referred to as a scalar success factor.

In accordance with one or more embodiments, various correspondence-per-foot estimations processes may be performed at a planning stage, following a drilling operation, and in real-time during a drilling operation. When drilling path data (e.g., predicted geosteering data) are determined prior to a drilling operation, some estimation methods may lack consistency from well-to-well and from driller-to-driller which may result in very different path outcomes. Likewise, differences may be significant between estimated paths prior to a drilling operation and measured paths from the actual drilling operation. For example, planning stages of a drilling operation may not consider many factors ultimately relevant to actual drilling, such as unknown geological features and actual performance of drilling components, such as different drill bits.

In some embodiments, an automated drilling manager determines changes to a drilling operation in real-time based on drilling path data. For example, the drilling path (e.g., a well path) follows a predetermined path. The real-time path varies in degree of its path correspondence to the predetermined path. Based on changes to a path correspondence-per-foot during a drilling run, an automated drilling manager may determine in real-time whether to adjust or terminate the drilling operation. For example, the method and system may transmit a command to terminate the drilling operation in response to determining that the drill path data fails to satisfy the predetermined criterion.

In another example, based on changes to a path correspondence-per-foot during a drilling run, an automated drilling manager may determine in real-time whether to adjust the drilling operation. For example, the automated drilling manager may determine to adjust one or more drilling parameters. For example, an adjusted drilling parameter is a change to the rate of penetration or a change to a different drill bit. The automated drilling manager may transmit a command to adjust the drilling operation based on the adjusted drilling parameter. In some embodiments, for example, an automated drilling manager determines a new drill bit for the ongoing drilling operation based on a hole size of a wellbore, different types of drill bits available for a drilling operation, parameters relating to a drilling system, and a rate of penetration record per run, and various properties relating to drilling fluids.

In some embodiments, an automated drilling manager includes functionality for using one or more machine-learning models (e.g., drilling models D 114) to determine drilling path data, i.e., predicted geosteering data (e.g., predicted geosteering data A 111). More specifically, a machine-learning model may characterize actual and/or predicted drilling paths (e.g., well paths) for a particular drilling operation based on geological factors, drilling factors, and other input data. For example, a machine-learning model may be used to determine instantaneous path coordinates in real-time (e.g., the correspondence with a planned path of drilling another foot in a well path in an ongoing drilling operation or paths associated with a particular section of a well path or a drilling run) of a drilling operation. Furthermore, machine-learning models may describe paths, such as whether the path correspondence to the planned path is increasing, decreasing, or remaining the same. Where different formations may require different amounts of time to traverse in a well path, a machine-learning model may provide predicted geosteering data reflecting changes in drilling paths due to changes in one or more drilling parameters or components.

In some embodiments, an automated drilling manager transmits one or more commands (e.g., drilling system command X 123) to various control systems in a well system (e.g., drilling system A 120, automated material transfer system A 135, automated mud property system B 130) in order to produce drilling operations with specific drilling parameters. For example, drilling parameters may include specific drilling fluid properties, such as predetermined density values or mud velocity values of a drilling fluid (e.g., drilling fluid A 181, drilling fluid B 182, recycled drilling fluid 185). Likewise, drilling parameters data (e.g., drilling parameter data B 112) may also include data that describes drill string properties, such as a specific weight-on-bit or rate of penetration (ROP) values. Commands may include data messages transmitted over one or more network protocols using a network interface, such as through wireless data packets. Likewise, a command may also be a control signal, such as an analog electrical signal, that triggers one or more operations in a particular control system (e.g., drilling system A 120).

Furthermore, an automated drilling manager may monitor various drilling fluid properties and drilling parameters in real-time. For example, drilling fluid properties may be monitored using one or more mud property sensors. Likewise, drilling parameters may be modified in real-time based on downhole sensors, drilling sensors (e.g., using drilling sensor data X 124), etc. In some embodiments, for example, the automated drilling manager modifies drilling parameters at predetermined intervals until user-defined properties are achieved by the well system 100. The user-defined properties may correspond to a selection by a user device (e.g., user selection Y 192 obtained by user device Y 190 using a graphical user interface Y 191). For example, an automated drilling manager may be coupled to a user device e.g., over a well network, or remotely (e.g., through a remote connection using Internet access or a wireless connection at a well site). Based on real-time updates received for a current drilling operation, a user and/or the automated drilling manager may modify previously-selected drilling parameters, e.g., in response to changes in a drill bit while drilling or drilling fluid within the wellbore.

Keeping with FIG. 1, an automated drilling manager, an automated material transfer system, and/or an automated mud property system may include one or more control systems that include one or more programmable logic controllers (PLCs). Specifically, a programmable logic controller may control valve states, fluid levels, pipe pressures, warning alarms, and/or pressure releases throughout a well system. In particular, a programmable logic controller may be a ruggedized computer system with functionality to withstand vibrations, extreme temperatures, wet conditions, and/or dusty conditions, for example, around a drilling rig. In some embodiments, the automated drilling manager 110, the automated material transfer system A 135, the automated mud property system B 130, and/or the user device Y 190 may include a computer system that is similar to the computer system (e.g., a computer 502) described below with regard to FIG. 5 and the accompanying description.

During some well operations, a lost circulation event may occur that results in a partial or complete loss of drilling fluid and/or cement slurry into a formation. For example, a lost circulation event may be brought on by natural causes or induced causes within the formation. Natural causes may include naturally-occurring fractures or caverns adjacent to a wellbore as well as unconsolidated zones. Induced causes may include a situation when a hydrostatic fluid pressure, such as a hydrostatic head created by drilling mud, exceeds a fracture gradient of the formation resulting in a fracture receiving fluid rather than resisting the fluid. When drilling into highly fractured formations, for example, severe fluid losses may be encountered that pose serious threats to drilling operations. Fluid losses may lead to various risks such as high costs of replacing drilling fluid during the drilling operation, formation damage left behind by lost circulation treatments, and even a possible loss of hydrostatic pressure that can cause an influx of gas or fluid, e.g., resulting in a well blowout. A technique to prevent inducing a loss is to utilize an underbalanced drilling operation. Underbalanced drilling refers to drilling with a mud weight that, for a given mud column height, results in a hydrostatic head that is slightly less than formation pressure.

With respect to drilling operations, various types of lost circulation material (LCMs) may be used in a lost circulation treatment to prevent or reduce drilling fluids from being lost inside downhole formations. LCM examples may include fibrous materials (e.g., cedar bark, shredded cane stalks, mineral fiber, and hair), flaky materials (e.g., mica flakes, pieces of plastic, and cellophane sheeting) or granular materials (e.g., ground and sized materials such as limestone, marble, wood, nut hulls, Formica, corncobs, and cotton hulls). A fibrous LCM may include long, slender, and flexible substances that are insoluble and inert, where the fibrous material may assist in retarding drilling fluid loss into fractures or highly permeable zones. A flaky LCM may be thin and flat in shape with a large surface area in order to seal off fluid loss zones in a wellbore and help stop lost circulation. A granular LCM may be chunky in shape with a range of particle sizes. LCMs may also include one or more bridging agents that may include solids added to a drilling fluid to bridge across a pore throat or fractures of an exposed rock thereby producing a filter cake to prevent drilling fluid loss or excessive filtration. Example bridging agents may include removable-common products include calcium carbonate (acid-soluble), suspended salt (water-soluble) or oil-soluble resins. In some embodiments, granular materials, flaky materials, and/or fibrous materials are combined into an LCM pill and pumped into a wellbore next to a zone experiencing fluid loss to seal the formation. Different types of LCM may have different costs. For example, bentonite may have a lower price than medium-grade mica or nut plug circulation materials.

Regarding automated mud processing systems, an automated mud processing system may include a controller coupled various feeders, various control valves, various mixing tanks, and/or a solid removal system for managing drilling fluid in a drilling operation. The controller may include hardware, such as a processor, coupled to various sensors around various well systems at a well site. With respect to a mixing tank, a mixing tank may be a container or other type of receptacle (e.g., a mud pit) for mixing various liquids, fresh mud, recycled mud, different types of LCMs, additives, and/or other chemicals to produce a particular drilling fluid mixture. For example, a mixing tank may be coupled to one or more mud supply tanks, one or more additive supply tanks, one or more dry/wet feeders, and one or more control valves for managing the mixing of chemicals within a respective mixing tank. Control valves may be used to meter chemical inputs into a mixing tank, as well as release drilling fluid into a mixing tank.

Figure 2:
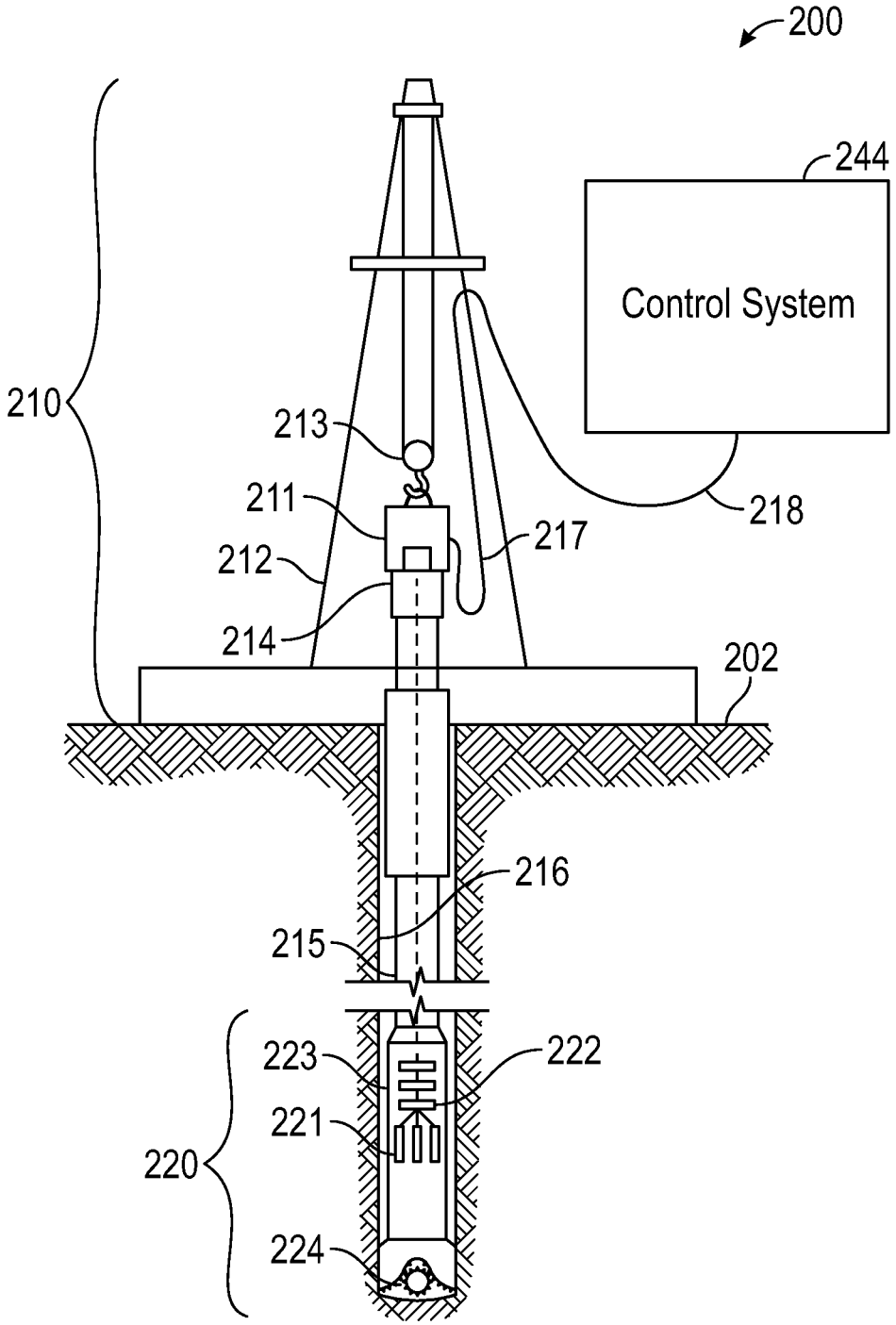

Turning to FIG. 2, FIG. 2 illustrates a system in accordance with one or more embodiments. As shown in FIG. 2, a drilling system 200 may be located on a ground surface (e.g., a surface 202) include a top drive drill rig 210 arranged around the setup of a drill bit logging tool 220. A top drive drill rig 210 may include a top drive 211 that may be suspended in a derrick 212 by a travelling block 213. In the center of the top drive 211, a drive shaft 214 may be coupled to a top pipe of a drill string 215, for example, by threads. The top drive 211 may rotate the drive shaft 214, so that the drill string 215 and a drill bit logging tool 220 cut the rock at the bottom of a wellbore 216. A power cable 217 supplying electric power to the top drive 211 may be protected inside one or more service loops 218 coupled to a control system 244. As such, drilling fluid may be pumped into the wellbore 216 using the drive shaft 214 and/or the drill string 215. Likewise, the drilling system may also include a mud pump, a mud line, mud pits, a mud return, and other components related to the circulation or recirculation of drilling fluid within the wellbore 216. The control system 244 may be similar to various control systems described above in FIG. 1 and the accompanying description, such as the automated drilling manager 110, the automated material transfer system A 135, and/or the automated mud property system B 130.

In some embodiments, the drilling system 200 includes a bottomhole assembly (BHA). The bottomhole assembly may refer to a lower portion of the drill string 215 that includes a drill bit 224, bit sub (i.e., a substitute adapter), and a drill collar. The bottomhole assembly may also include a mud motor, stabilizers, heavy-weight drill pipe, jarring devices ("jars"), crossovers for various threadforms, directional drilling and measuring equipment, measurements-while-drilling tools, logging-while-drilling tools, and other specialized devices. The bottomhole assembly may produce force for the drill bit to break rock and provide the drilling system with directional control of a wellbore. Different types of bottomhole assemblies may be used, such as a rotary assembly, a fulcrum assembly, and a pendulum assembly.

Moreover, when completing a well, casing may be inserted into the wellbore 216. The sides of the wellbore 216 may require support, and thus the casing may be used for supporting the sides of the wellbore 216. As such, a space between the casing and the untreated sides of the wellbore 216 may be cemented to hold the casing in place. The cement may be forced through a lower end of the casing and into an annulus between the casing and a wall of the wellbore 216. More specifically, a cementing plug may be used for pushing the cement from the casing. For example, the cementing plug may be a rubber plug used to separate cement slurry from other fluids, reducing contamination and maintaining predictable slurry performance. A displacement fluid, such as water, or an appropriately weighted drilling fluid, may be pumped into the casing above the cementing plug. This displacement fluid may be pressurized fluid that serves to urge the cementing plug downward through the casing to extrude the cement from the casing outlet and back up into the annulus.

As further shown in FIG. 2, sensors 221 may be included in a sensor assembly 223, which is positioned adjacent to a drill bit 224 and coupled to the drill string 215. Sensors 221 may also be coupled to a processor assembly that includes a processor, memory, and an analog-to-digital converter 222 for processing sensor measurements. For example, the sensors 221 may include acoustic sensors, such as accelerometers, measurement microphones, contact microphones, and hydrophones. Likewise, the sensors 221 may include other types of sensors, such as transmitters and receivers to measure resistivity, gamma ray detectors, etc. The sensors 221 may include hardware and/or software for generating different types of well logs (such as acoustic logs or density logs) that may provide well data about a wellbore, including porosity of wellbore sections, gas saturation, bed boundaries in a geologic formation, fractures in the wellbore or completion cement, and many other pieces of information about a formation. If such well data is acquired during drilling operations (i.e., logging-while-drilling), then the information may be used to make adjustments to drilling operations in real-time. Such adjustments may include rate of penetration (ROP), drilling direction, altering mud weight, and many others drilling parameters.

In some embodiments, acoustic sensors may be installed in a drilling fluid circulation system of the drilling system 200 to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, casing shoe positioning, etc.

The control system 244 may be coupled to the sensor assembly 223 in order to perform various program functions for up-down steering and left-right steering of the drill bit 224 through the wellbore 216. More specifically, the control system 244 may include hardware and/or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit 224 or drill string 215 relative to a boundary between different subsurface layers (e.g., overlying, underlying, and lateral layers of a pay zone) during drilling operations. In particular, measuring rock properties during drilling may provide the drilling system 200 with the ability to steer the drill bit 224 in the direction of desired hydrocarbon concentrations. As such, a geosteering system may use various sensors located inside or adjacent to the drill string 215 to determine different rock formations within a well path. In some geosteering systems, drilling tools may use resistivity or acoustic measurements to guide the drill bit 224 during horizontal or lateral drilling.

In accordance with one or more embodiments the drill string 215 may comprise a coiled tubing. Coiled tubing may be wound on a spool prior to drilling the wellbore 216 and is straightened for pushing into the wellbore. The drill string comprises the drill bit that is disposed at a downhole end of the drill string. The drill bit drills the wellbore into the formation. The wellbore may run diagonally in an upper section close to the ground surface and horizontally in a lower section distant from the ground surface.

Embodiments disclosed here relate to a method and system for the development of an intelligent technology solution to advise and guide the operator on intelligent underbalanced coiled tubing drilling (UBCTD) geosteering plans for optimal decision making to enhance well placement, maximize reservoir contact, and improve geosteering efficiency.

The method and system may collect well-related data. For example, the automated drilling manager may obtain the data sample. The data sample may include historical data and real-time data (data acquired in real time.) The system sources several past UBCTD historical completed operations and analyzes trends and patterns for operational parameters such as drilling parameters, well parameters, and reservoir parameters in addition to the success factor and performance. The system reports similarities and indicators to support optimization of future planned wells within the same field and reservoir.

The drilling parameters include, amongst others, rate of penetration (ROP), weight on bit (WOB), mud weight, and other associated parameters. The drilling parameters play a crucial role in determining the formation and providing implicit information on the geomechanics of the formation, and indirectly on its porosity.

The well parameters incorporate the production performance, such as gas production, the well length and trajectory, net-to-gross ratio, formation intersections, TVD, and MD in addition to completion parameters.

Furthermore, several reservoir parameters are sourced from the reservoir environment, which may include reservoir geology, bio-steering derived information, as well as rock cuttings provided information.

The data sample obtained by the automated drilling manager may be processed in various manners to clean up the data. For example, the data sample may be cleaned to ensure an accurate representation of the measured parameters. For example, cleaning the data sample may include removing outliers, removing highly-uncertain data sources, and checking data consistency of input data sources.

Extreme values in the data sample may be referred to as data outliers. Data outliers may fall well outwith the range of expectations and, if included in the modeling, may distort the model from the accurate representation. The data sample may have outliers removed. For example, the machine-learning model may use a standard deviation and/or interquartile range to identify and remove outliers from the data sample. Outliers may be detected automatically and/or may be removed automatically. Removing the outliers from a data sample forms a set of first narrowed data.

The data sample may be further processed in various manners to determine the data source confidence and to estimate data source uncertainty. For example, a bounds on an estimate of a population parameter may be used as a confidence interval. The confidence, for example, may fall within a range that may be greater than a threshold value, etc. A classification method for a confidence interval of an estimate may be calculated directly. Furthermore, using the bootstrap, an estimate of the confidence interval for any arbitrary population statistic may be made in a distribution-free manner.

Highly-uncertain data sources may be removed. Removing the highly-uncertain data sources from a data sample forms a set of second narrowed data. Using the first narrowed data and the second narrowed data may help determine a data consistency of the data. For example, the data consistency between first acquired drilling parameter data and the planned correspondence-per-length may be determined using the first narrowed data and the second narrowed data. In another example, the data consistency between the first acquired drilling parameter data, a second well path data, and a third well path data may be determined. Data consistency between historical well data for one or more wells and the first acquired drilling parameter data, and the second, and/or third well path data may be determined.

The automated drilling manager may measure the success factor. The success factor may be, for example, a numerical value and/or a categorical variable. The data are then related to the success factor of a specific well, where the success factor is a value between 0 and 1, where 1 represents high success and 0 no success. Each success factor may be compared with other success factors (e.g., historical well data success factors) aggregated to form a data set to determine a percentile for each individual success factor. The parameter may be either a scalar quantity (such as a numerical value of 0 to 1) or categorical variable (e.g., unsuccessful, somewhat unsuccessful, moderately successful, mostly successful, successful).

The method and system may train the network in terms of the similarity between the wells. The success factor in addition to the mentioned previous parameters are then incorporated into a similarity learning framework to form a trained similarity model. The similarity learning model utilizes a Pearson correlation coefficient, nearest neighbor, deep learning approach (e.g., a Pearson correlation, k-nearest neighbor approach) to evaluate the proximity between the various data of various parameters, based on a decision tree estimate together with a feature importance analysis. For example, a neural network may determine which data inputs should receive greater priority, i.e., importance, in determining one or more specified outputs of the neural network. The feature importance analysis may assign various weights (weighting factors) to various drilling parameters. The well trajectory may be a numerical three-dimensional matrix of coordinates. The assigning of various weights may be accounted for when applied to the matrix of coordinates during the weighting. In this manner the method and system performs a weighing of importance of drilling parameters. Each of one or more drilling parameters in a set of drilling parameters may be assigned a drilling parameter importance.

The success factor and the other parameters are then incorporated into a similarity learning framework. The similarity learning model may utilize a Pearson's correlation, nearest neighbor, deep learning approach to evaluate the proximity between the various data, based on a decision tree estimate together with a feature importance analysis.

The method and system may assess the importance of the various input factors. The intelligent UBCTD geosteering advisory method and system may automatically determine similarity of a new well based on existing drilled wells. The method and system may automatically determine the most impactful parameters on the well rate success, i.e., various parameters may have a higher weight in terms of impactfulness to the well rate success. For example, for a given resource such as the Khuff Formation, in comparing wells in reservoirs Khuff-B and Khuff-C, an impactful parameter may be net-to-gross (NTG) hydrocarbons. NTG is a ratio of the volume of hydrocarbons in place within a reservoir.

For a new planned well, the method may assess the success rate based on the closest matching well. The similarity learning framework is then utilized to determine the most likely success factor based on the similarity to previously drilled wells. The system classifies areal coverage of the field and identifies areas of highest success while pinpointing areas of the field with great potential to improve and optimize operations and resources. The system ranks all future candidates based on success criteria and historical knowledge of lessons learned.

The system thereby solves technical problems relating to planning new wells. Real-time assessment of the success factor of a planned well is essential in order to enhance planning of new wells. The technology enables operators to assess the similarity with previously drilled wells, and then optimize the new well based on data analytics. For example, the similarity learning model analyzes and processes the acquired drilling parameter data. Data may be integrated into the system to analyze and report the results. The system utilizes an artificial intelligence (AI) framework for the evaluation of similarities and indicators between different wells for UBCTD, enabling an operator to assess and enhance the well placement and decision making. The system analyzes historical well data and reports findings in a visual or graphical scheme to identify successful candidates and others. The system then categorizes and groups wells by area and/or region to help plan future planned wells and to assist in optimization of the wells.

In accordance with one or more embodiments the intelligent UBCTD geosteering advisory system may offer the following advantages to optimize well planning for UBCTD. The system may automatically determine similarity of a new planned well for UBCTD based on existing drilled wells. The system may analyze and process data in real-time for the similarity assessment. The system may automatically determine the most impactful parameters on the well rate success, i.e., the system may classify the success rate for a well. The system may provide flexibility to utilize either a scalar or categorical parameter (i.e., scalar success factor or categorical success factor) for the determination of well rate success. The system may automatically scale and process various well-related data sources. The system may provide decision recommendations on the drilling of a new planned UBCTD well. The system may automatically integrate and scale various well sources. The system may automatically estimate the importance of various input features.

Returning to FIG. 1, a user device (e.g., user device Y 190) may provide a graphical user interface (e.g., graphical user interface Y 191) for communicating with an automated drilling manager, e.g., to monitor drilling operations, drilling fluid operations, and predicted geosteering data (e.g., predicted geosteering data A 111). For example, a user device may be a personal computer, a man-machine interface, a human-machine interface, a smartphone, or another type of computer device for presenting information and obtaining user inputs in regard to the presented information. Likewise, the user device may obtain various user selections (e.g., user selection Y 192) regarding drilling operations, such as based on real-time changes to predicted geosteering for a wellbore.

Likewise, the user device may display various reports that may include charts as well as other arrangements of well data (e.g., drilling operation record Y 193 includes correspondence-per-foot value Y 194).

For example, the method may determine an adjusted well path if the first acquired drilling parameter data is worse than the targeted correspondence-per-length rate and in that case then the user device presents that the first acquired drilling parameter data is worse than the targeted correspondence-per-length rate. The user device may then present one or more adjusted well paths in response to presenting the first predicted drill path data is worse than the targeted correspondence-per-length. The user may make a user selection of the one or more adjusted well paths.

Likewise, the method may determine an adjusted well path if the predicted drill path data is worse than the targeted correspondence-per-length rate and in that case then the user device presents that the predicted drill path data is worse than the targeted correspondence-per-length rate.

In some embodiments, an automated drilling manager includes hardware and/or software with functionality for generating and/or updating one or more machine-learning models to determine predicted geosteering data. For example, a predicted geosteering model may correspond to one or more types of machine-learning models that are trained to predict predicted geosteering data. Examples of machine-learning models may include artificial neural networks, such as convolutional neural networks, deep neural networks, and recurrent neural networks. Machine-learning models may also include support vector machines, decision trees, inductive-learning models, deductive-learning models, supervised learning models, unsupervised learning models, reinforcement learning models, etc. In a deep neural network, for example, a layer of neurons may be trained on a predetermined list of features based on the previous network layer's output. Thus, as data progresses through the deep neural network, more complex features may be identified within the data by neurons in later layers. Likewise, a U-net model or other type of convolutional neural network model may include various convolutional layers, pooling layers, fully connected layers, and/or normalization layers to produce a particular type of output. Thus, convolution and pooling functions may be the activation functions within a convolutional neural network.

In some embodiments, two or more different types of machine-learning models are integrated into a single machine-learning architecture, e.g., a machine-learning model may include support vector machines and neural networks. In another example, a machine-learning model may include k-nearest neighbor (k-NN) models and neural networks. In some embodiments, an automated drilling manager may generate augmented data or synthetic data to produce a large amount of interpreted data for training a particular model. Likewise, an automated drilling manager may obtain a variety of geosteering data and physical well site data for validating a predicted geosteering model.

In some embodiments, various types of machine-learning algorithms may be used to train the model, such as a backpropagation algorithm. In a backpropagation algorithm, gradients are computed for each hidden layer of a neural network in reverse from the layer closest to the output layer proceeding to the layer closest to the input layer. As such, a gradient may be calculated using the transpose of the weights of a respective hidden layer based on an error function (also called a "loss function"). The error function may be based on various criteria, such as mean squared error function, a similarity function, etc., where the error function may be used as a feedback mechanism for tuning weights in the machine-learning model.

With respect to artificial neural networks, for example, an artificial neural network may include one or more hidden layers, where a hidden layer includes one or more neurons. A neuron may be a modelling node or object that is loosely patterned on a neuron of the human brain. In particular, a neuron may combine data inputs with a set of coefficients, i.e., a set of network weights for adjusting the data inputs. These network weights may amplify or reduce the value of a particular data input, thereby assigning an amount of significance to various data inputs for a task being modeled. Through machine learning, a neural network may determine which data inputs should receive greater priority in determining one or more specified outputs of the artificial neural network. Likewise, these weighted data inputs may be summed such that this sum is communicated through a neuron's activation function to other hidden layers within the artificial neural network. As such, the activation function may determine whether and to what extent an output of a neuron progresses to other neurons where the output may be weighted again for use as an input to the next hidden layer.

Turning to recurrent neural networks, a recurrent neural network (RNN) may perform a particular task repeatedly for multiple data elements in an input sequence (e.g., a sequence of temperature values from an inlet to an outlet), with the output of the recurrent neural network being dependent on past computations. As such, a recurrent neural network may operate with a memory or hidden cell state, which provides information for use by the current cell computation with respect to the current data input. For example, a recurrent neural network may resemble a chain-like structure of RNN cells, where different types of recurrent neural networks may have different types of repeating RNN cells. Likewise, the input sequence may be time-series data, where hidden cell states may have different values at different time steps during a prediction or training operation. For example, where a deep neural network may use different parameters at each hidden layer, a recurrent neural network may have common parameters in an RNN cell, which may be performed across multiple time steps. To train a recurrent neural network, a supervised learning algorithm such as a backpropagation algorithm may also be used. In some embodiments, the backpropagation algorithm is a backpropagation through time (BPTT) algorithm. Likewise, a BPTT algorithm may determine gradients to update various hidden layers and neurons within a recurrent neural network in a similar manner as used to train various deep neural networks. In some embodiments, a recurrent neural network is trained using a reinforcement learning algorithm such as a deep reinforcement learning algorithm. For more information on reinforcement learning algorithms, see the discussion below.

Embodiments are contemplated with different types of RNNs. For example, classic RNNs, long short-term memory (LSTM) networks, a gated recurrent unit (GRU), a stacked LSTM that includes multiple hidden LSTM layers (i.e., each LSTM layer includes multiple RNN cells), recurrent neural networks with attention (i.e., the machine-learning model may focus attention on specific elements in an input sequence), bidirectional recurrent neural networks (e.g., a machine-learning model that may be trained in both time directions simultaneously, with separate hidden layers, such as forward layers and backward layers), as well as multidimensional LSTM networks, graph recurrent neural networks, grid recurrent neural networks, etc. Regarding LSTM networks, an LSTM cell may include various output lines that carry vectors of information, e.g., from the output of one LSTM cell to the input of another LSTM cell. Thus, an LSTM cell may include multiple hidden layers as well as various pointwise operation units that perform computations such as vector addition.

In some embodiments, an automated drilling manager uses multiple k-nearest neighbor models to predict data (e.g., path data and/or path correspondence data). For example, a k-nearest neighbor (k-NN) model may be an algorithmic model based on a non-parametric classification algorithm or a regression algorithm. Thus, the algorithm's inputs may include the k closest training examples within a feature set, while the algorithm's output may depend on whether the k-NN algorithm is used for classification or regression. For a k-NN classification example, the output may be one or more predetermined class types. In other words, an object may be classified by a plurality vote of multiple neighbor nodes, with the object being assigned to the class most common (e.g., in greatest proximity) among its k-NN nodes. If there is only a single nearest neighbor node, then the object may be simply assigned to the corresponding class of that single nearest neighbor. In a k-NN regression example, the output may be the property value for the object. As such, this property value may be the average of the values of k nearest neighbor nodes.

In some embodiments, an automated drilling manager uses one or more ensemble-learning methods in connection to one or more predicted geosteering models. For example, an ensemble-learning method may use multiple types of machine-learning models to obtain better predictive performance than available with a single machine-learning model. In some embodiments, for example, an ensemble architecture may combine multiple base models to produce a single machine-learning model. One example of an ensemble-learning method is a BAGGing model (i.e., BAGGing refers to a model that performs Bootstrapping and Aggregation operations) that combines predictions from multiple neural networks to add a bias that reduces variance of a single trained neural network model. Another ensemble-learning method includes a stacking method, which may involve fitting many different model types on the same data and using another machine-learning model to combine various predictions.

While FIGS. 1 and 2 shows various configurations of components, other configurations may be used without departing from the scope of the disclosure. For example, various components in FIGS. 1 and 2 may be combined to create a single component. As another example, the functionality performed by a single component may be performed by two or more components.

Figure 3:
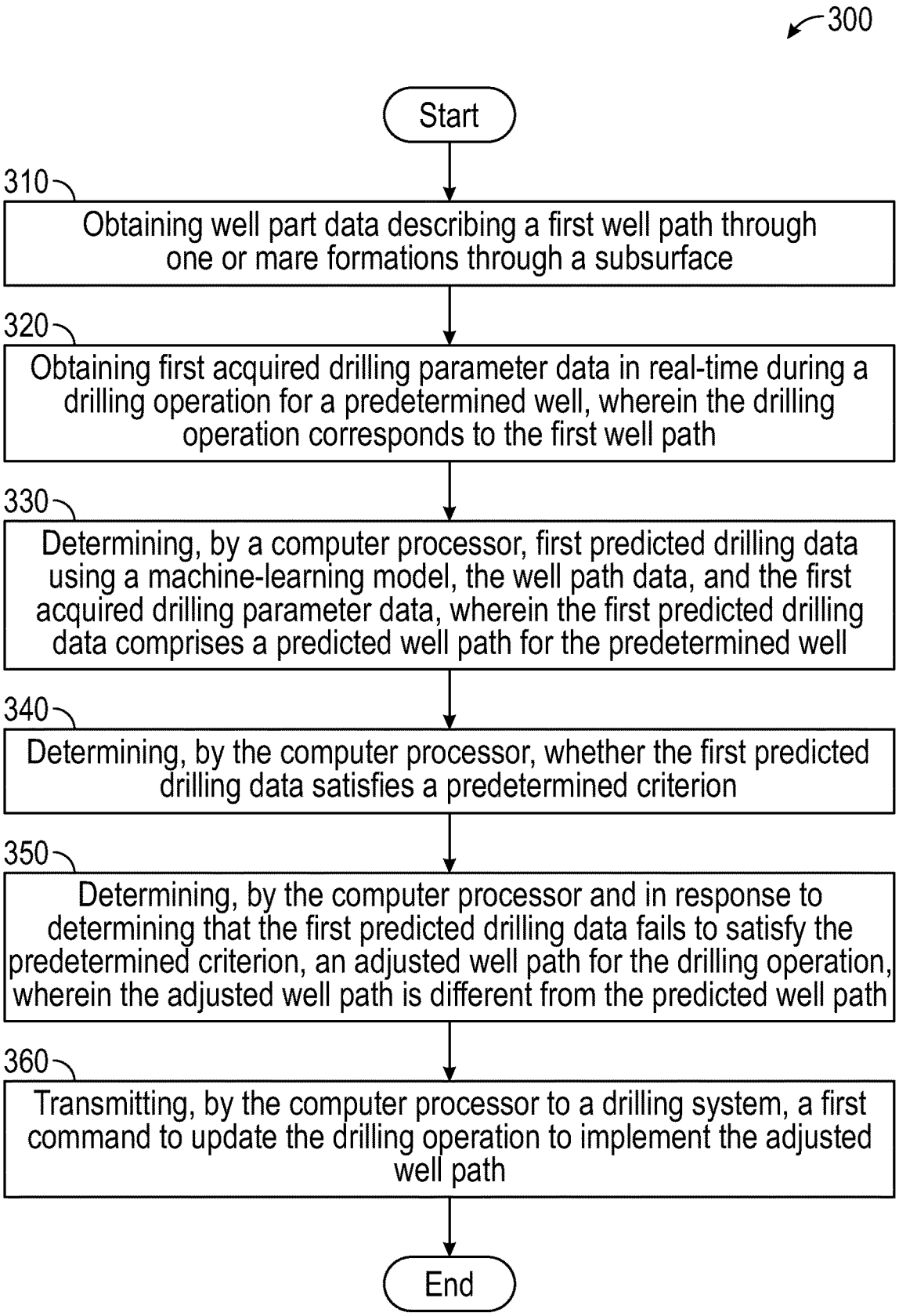
FIG. 3 shows a flowchart in accordance with one or more embodiments.

Turning to FIG. 3, FIG. 3 shows a flowchart in accordance with one or more embodiments. Specifically, FIG. 3 describes a general method (e.g., a method 300) for managing a drilling operation based on predicted geosteering data. One or more blocks in FIG. 3 may be performed by one or more components (e.g., automated drilling manager 110) as described in FIGS. 1 and 2. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At step 310, the method includes obtaining well path data describing a first well path through one or more formations of a subsurface, in accordance with one or more embodiments. Well path data includes, for example, planned/desired path data and corresponding historic data. Historic data may be from historical UBCTD operations of wells such as petrophysical, geologic, and production data. The data may come from nearby wells. Historical well data are obtained for one or more wells within a predetermined distance of a predetermined well in accordance with one or more embodiments. For example, historical well data may identify geological data relating to one or more wells, such as the type of formation, reservoir, or basin. Historical well data may also include drilling well path correspondence-per-length data relating to the drilling operation for the historical well, as well as the drilling parameters associated with drilling the historical well. Using historical well data for multiple wells, an automated drilling manager may match or correlate historical well data to predict data at a new well. In particular, an automated drilling manager or a user may determine a distance range to determine which historical wells to analyze with respect to the new well. For example, an automated drilling manager may obtain a user selection of the predetermined distance of 500 feet from the new well.

At step 310, in some embodiments, an automated drilling manager searches a database to determine benchmarks of the current drilling path correspondence with what drilling path correspondences were achieved historically. As such, an automated drilling manager may use various filters to sort and analyze different historical wells. Example filters include location of the historical wells (e.g., is a potential historical well within a distance of two-hundred feet from a well of interest) and the type of formations drilled in a historical well in comparison to formations in the well of interest. Thus, for a given run, drilling path correspondence-per-length may be calibrated using historical well data in order to predict drilling paths for the current well.

At step 310, the well path data may be divided into five groups: drilling parameters, well parameters, reservoir parameters, success factors, and performance information. Drilling parameters include, for example, ROP, WOB, mud weight, and others. Well parameters include, for example, well length/TVD, MD, well trajectory, net-to-gross ratio, formation intersections, etc. Reservoir parameters include reservoir geology, bio-steering derived information, rock cuttings, etc. Success factors include how closely the historical well data conformed to the well path tolerances (correspondence-per-length) in the form of a scalar success factor or as a categorical success factor. Performance includes the production performance (e.g., gas production), actual or predicted ultimate recovery, flow/saturation, density/velocity petroelastic parameters, pressure, permeability, oil/gas chemistry, porosity, reservoir dynamics (stratigraphy, lithology, permeability, fluid saturations, etc.)

At step 320, the method includes obtaining first acquired drilling parameter data for a well path regarding one or more drilling parameters in real-time during a drilling operation for a predetermined well in accordance with one or more embodiments. The drilling operation corresponds to the first well path. For example, different metrics may contribute to a final path of a drilling operation, such as rate of penetration (ROP) data, weight on bit (WOB) data, torque data, mud weight data, pump pressure data, and metrics of other associated parameters. Acquired drilling parameter data contributing to a final path are well path parameters such as the current drilling direction, inclination, azimuth, and coordinates. The drilling parameters play a crucial role in determining the formation and provide implicit information on the geomechanics of the formation, and indirectly on its porosity. Acquired drilling parameter data may also include well log data, e.g., to identify the type of formation being drilled in a particular well path.

In step 310, in some embodiments, drilling parameter data is obtained using a wellsite data protocol, such as a protocol based on a Wellsite Information Transfer Specification (WITS) or a Well-site Information Transfer Standard Markup Language (WITSML). For example, a wellsite data protocol may be a network communication format used within the oil and gas drilling industry for the transfer of well site data from one computer system to another computer system. Thus, one or more drilling systems may transmit drilling parameter data to an automated drilling manager using one or more wellsite data protocols. Likewise, a wellsite data protocol may be used to transmit drilling parameter data offsite from a well network, such as to communicate data to a producing oil company operating the drilling rig.

At step 330, the method includes determining, by a computer processor, first predicted drilling data using a machine-learning model, the well path data, and the first acquired drilling parameter data, wherein the first predicted drilling data comprises a predicted well path for the predetermined well. In some embodiments a machine-learning model may be a deep neural network that is trained using a supervised machine-learning algorithm and well data for multiple historical wells. Thus, using geological data and drilling data, the machine-learning model may determine predicted well path data.

At step 330 the machine-learning model uses the historical well data from wells with similar geological and/or drilling parameters in order to predict drilling path data. For example, a machine-learning model may determine in real-time the correspondence-per-length of drilling a particular well. Example input parameters include coiled tubing drilling system parameters, type of well such as onshore or offshore, vertical well or directional drilling/degree of horizontal well, bottomhole assembly parameters, such as drill bit and mud motor type, wellbore size, coiled tubing size, such as 2⅜ inches, communication line such as e-line, and underbalanced fluids parameters such as water and nitrogen.

At step 330, the method includes determining, for example, first predicted geosteering data. The first predicted geosteering data may comprise a real-time path of drilling the predetermined well using the current drilling parameters of the drilling operation. Well path data are obtained in real time for a drilling operation based on one or more machine-learning models, acquired drilling parameter data, and historical well data, in accordance with one or more embodiments. For example, well path data may describe the overall predicted well path of a drilling operation, changes to the well path of the drilling operation (e.g., changes to the correspondence-per-length), and/or changes to individual drilling runs that make up the overall well path.

At step 330, in some embodiments, for example, drilling data includes a correspondence-per-length (accuracy) of drilling a well. In particular, the drilling correspondence data may be determined, evaluated, and/or compared with historical performances of various historical wells in real-time within a drilling operation. By having access to drilling accuracy data, a user may assess drilling accuracy during drilling, such as to quantify based on the drilling accuracy if the drillers should decide to pull out of a wellbore at a given time (e.g., if drilling the well path dramatically exceeds original planned tolerances for drilling a well). In this case the drillers terminate the drilling operation.

At step 330, the system may include a user device coupled to the control system. The first predicted drilling data may be presented on a graphical user interface of the user device. The first predicted drilling data may be presented in real-time to one or more user devices in accordance with one or more embodiments. In some embodiments, drilling data may be monitored using one or more user devices. For example, drilling data may be presented on a display device using a correspondence-per-length curve (e.g., a correspondence-per-foot or correspondence-per-meter curve) in real-time. Along with plotting drilling data versus time, an automated drilling manager may also plot a drilling curve versus depth (e.g., TVD and MD), an initially planned correspondence value (e.g., a planned correspondence-per-length value), and a comparison with current drilling parameter values and/or historical performance values. Thus, drilling success data may be quantified based on performance percentiles (e.g., 90th percentile, 75th percentile, 60th percentile, etc.). Moreover, drilling data may be presented with qualitative analysis, such as whether drilling correspondence-per-length values are increasing or decreasing. Likewise, an automated drilling manager may transmit one or more alert notifications to various user devices if a drilling correspondence-per-length exceeds one or more predetermined thresholds (e.g., correspondence is lower than historical data predicted; low correspondence means that the data exceeds tolerances).

At step 330, in some embodiments, a section of a well path or drilling run is identified in presented data that has the highest achieved correspondence (i.e., was the most accurate). Thus, real-time drilling data may be compared with estimated drilling data. For example, a bottomhole assembly may be removed from a wellbore and replaced based on a targeted correspondence-per-length. At the beginning of a drilling run, for example, a drilling operation may stop in order to change to a more accurate combination of components based on geological and drilling conditions.

At step 330, In some embodiments, drilling path data may include changing components of the bottom hole assembly. Thus, the system and method may determine well path data that describe well path impacts associated with different decisions, such as using the current drill bit or a replacement drill bit, replacing any other components in a bottomhole assembly, or terminating a drilling operation altogether. Likewise, well path data may describe multiple scenarios of different combinations of components (e.g., multiple different drill bits may be used in a single drilling operation), where a user device may select the most accurate combination for the remaining portion of a drilling operation.)

At step 340, the method includes determining, by the computer processor, whether the first predicted drilling data satisfies a predetermined criterion in accordance with one or more embodiments. For example, the predetermined criterion may be a tolerance on a coordinate (such as x, y, z) or an angle (such as azimuth and inclination) that comprise the correspondence-per-length. The predetermined criterion may apply to an entire drilling operation or a particular section of a well path. Likewise, predetermined criteria may be user-defined based on a user selection in a user interface or automatically determined by an automated drilling manager based on acquired current or historical well data. For example, an automated drilling manager may determine a predetermined criterion based on a predetermined correspondence-per-length for similar drilling operations through similar geological formations. If it is determined that the correspondence-per-length data satisfies the predetermined criterion, the process may return to step 320. If a determination is made that the correspondence-per-length data fails to satisfy the predetermined criterion, the process may proceed to step 350.

At step 350, the method includes determining, by the computer processor and in response to determining that the first predicted drilling data fails to satisfy the predetermined criterion, an adjusted well path for the drilling operation, wherein the adjusted well path is different from the predicted well path, in accordance with one or more embodiments. In some embodiments, for example, a drill bit is replaced based on the current correspondence-per-length of the drilling operation. For example, a drill bit may be worn down, such that a replacement drill bit may improve performance of the drilling operation such that the overall well path correspondence-per-length meets the predetermined correspondence per length. Likewise other drilling parameters or other components may be replaced to return the drilling operation to a state in which the correspondence-per-length satisfies the predetermined criteria. For example, selecting a suitable replacement mud weight may be based on various geological factors, such as pore pressure, rock hardness, and TVD.

At step 360, the method includes transmitting, by the computer processor to a drilling system, a first command to update the drilling operation to implement the adjusted well path. The method may include transmitting, by the computer processor to a drilling system, a first command to adjust a drilling component, such as changing a drill bit, or to adjust a drilling parameter such as changing a mud weight. For example, commands may be transmitted to various control systems to stop drilling or to perform other operations necessary for adjusting components and or adjusting drilling parameters. Likewise, a user or an automated drilling manager may select different replacement components or adjusted drilling parameters to achieve different correspondence-per-length values. A user selection may be obtained within a graphical user interface and be part of the request from a user device to replace a component.

Figure 4:
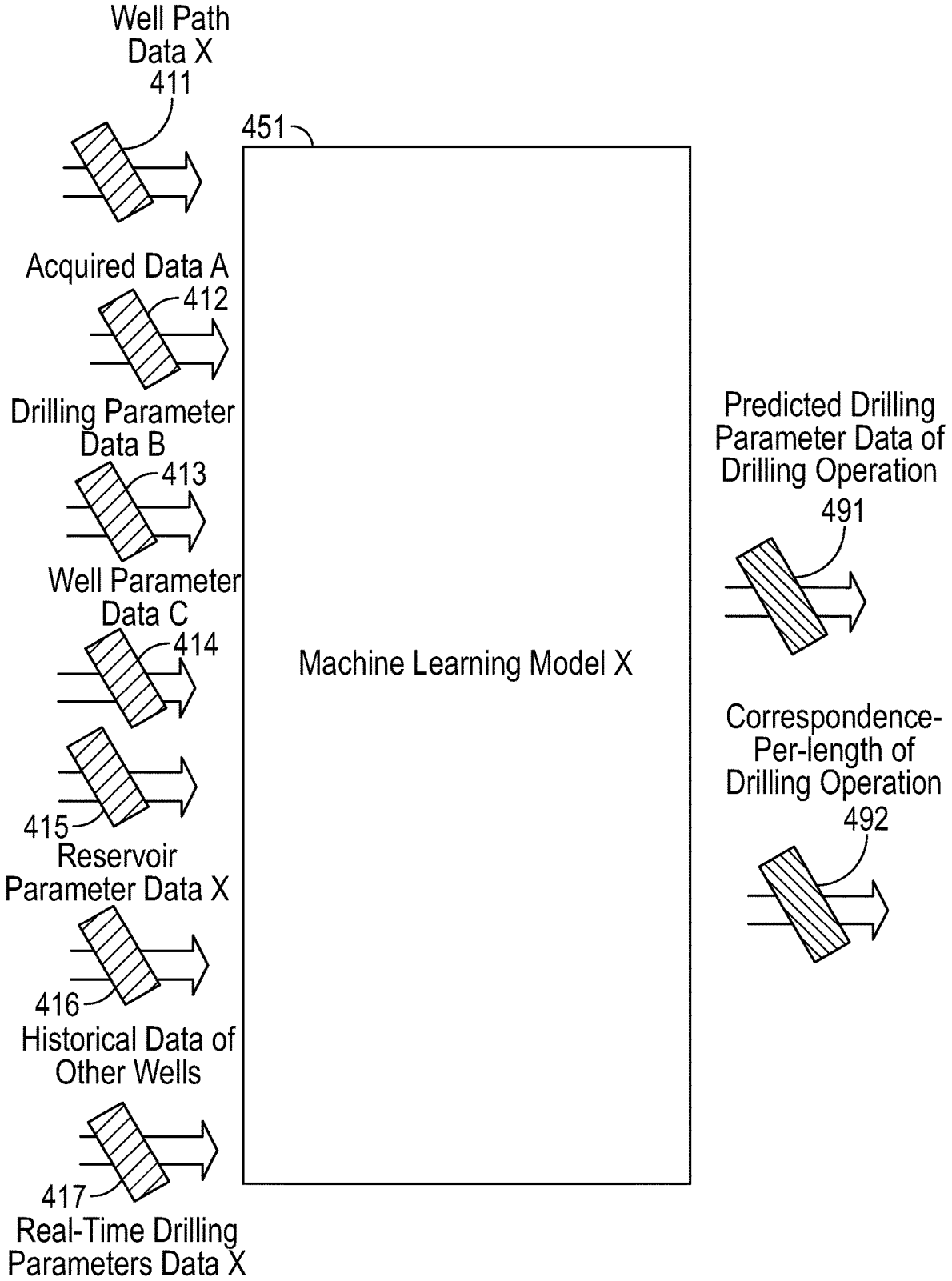
FIG. 4 shows an example in accordance with one or more embodiments.

Turning to FIG. 4, FIG. 4 provides an example of a machine-learning model in accordance with one or more embodiments. In FIG. 4, a machine-learning model X 451 determines predicted drilling parameter data 491 of a drilling operation and a predetermined criterion, i.e., correspondence per length 492 of a drilling operation. More specifically, the machine-learning model X 451 obtains the following inputs, i.e., well path data X 411, acquired data A 412, drilling parameter data B 413, well parameter data C 414, reservoir parameter data X 415, historical data 416 of other wells, and real-time drilling parameter data X 417. The predetermined correspondence per length 492 may be based on the historical data 416 and other historical well data (not shown). Based on the input data, the machine-learning model X 451 determines predicted drilling parameter data 491 for proceeding with the current drilling operation. Predicted drilling parameter data 491 may be measured in a correspondence-per-length of proceeding with a drilling operation, for example. This predicted drilling parameter data 491 may also be compared with data from various acquired drilling parameters such as first acquired drilling parameter data, second acquired drilling parameter data corresponding to a second well path, and third acquired drilling parameter data corresponding to a third well path, etc.

Figure 5:
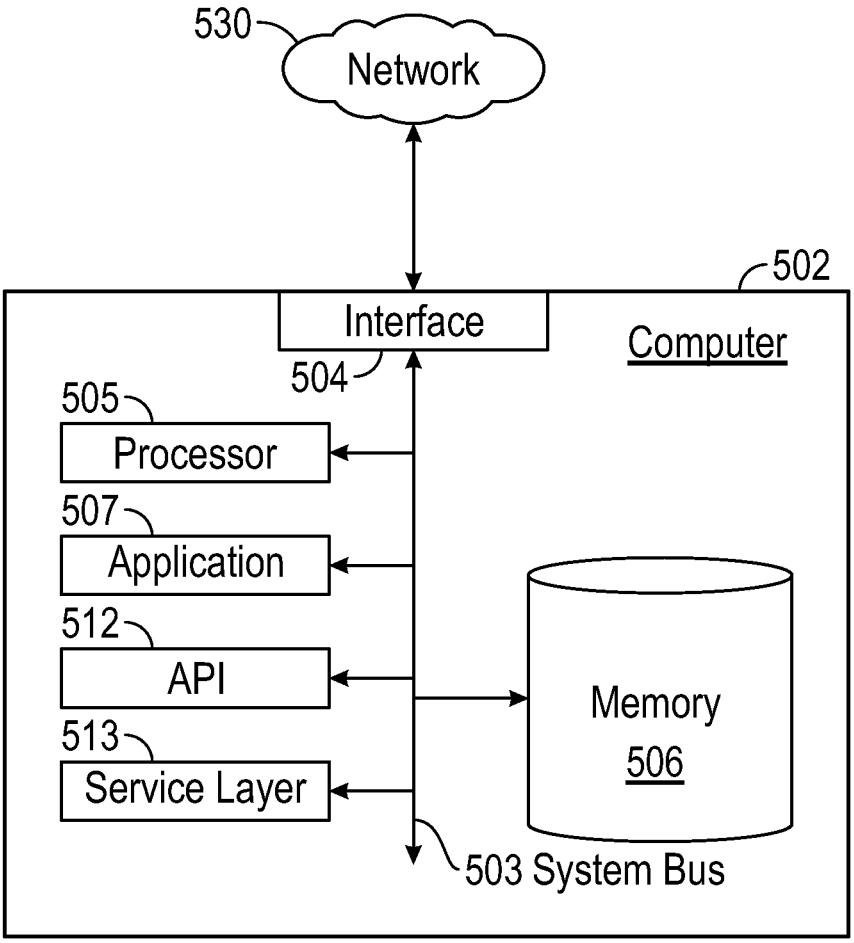
FIG. 5 shows a computer system in accordance with one or more embodiments.

Embodiments may be implemented on a computer system. FIG. 5 is a block diagram of a computer system (e.g., a computer 502) used to provide computational functionalities associated with described algorithms, methods, functions, processes, flows, and procedures as described in the instant disclosure, according to an implementation. The illustrated computer is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer may include a computer that includes an input device, such as a keypad, keyboard, touch screen, or other device that can accept user information, and an output device that conveys information associated with the operation of the computer, including digital data, visual, or audio information (or a combination of information), or a GUI.

The computer can serve in a role as a client, network component, a server, a database or other persistency, or any other component (or a combination of roles) of a computer system for performing the subject matter described in the instant disclosure. The illustrated computer is communicably coupled with a network 530 or cloud. In some implementations, one or more components of the computer may be configured to operate within environments, including cloud-computing-based, local, global, or other environment (or a combination of environments).

At a high level, the computer 502 is an electronic computing device operable to receive, transmit, process, store, or manage data and information associated with the described subject matter. According to some implementations, the computer 502 may also include or be communicably coupled with an application server, e-mail server, web server, caching server, streaming data server, business intelligence (BI) server, or other server (or a combination of servers).

The computer can receive requests over the network or cloud from a client application (for example, executing on another computer 502) and responding to the received requests by processing the said requests in an appropriate software application. In addition, requests may also be sent to the computer 502 from internal users (for example, from a command console or by other appropriate access method), external or third-parties, other automated applications, as well as any other appropriate entities, individuals, systems, or computers.

Each of the components of the computer 502 can communicate using a system bus 503. In some implementations, any or all of the components of the computer 502, both hardware or software (or a combination of hardware and software), may interface with each other or with an interface (e.g., interface 504) (or a combination of both) over the system bus 503 using an application programming interface (e.g., an API 512) or a service layer 513 (or a combination of the API and service layer. The API may include specifications for routines, data structures, and object classes. The API may be either computer-language independent or dependent and refer to a complete interface, a single function, or even a set of APIs. The service layer provides software services to the computer 502 or other components (whether or not illustrated) that are communicably coupled to the computer 502. The functionality of the computer 502 may be accessible for all service consumers using this service layer. Software services, such as those provided by the service layer 513, provide reusable, defined business functionalities through a defined interface. For example, the interface may be software written in JAVA, C++, or other suitable language providing data in extensible markup language (XML) format or other suitable format. While illustrated as an integrated component of the computer 502, alternative implementations may illustrate the API 512 or the service layer 513 as stand-alone components in relation to other components of the computer 502 or other components (whether or not illustrated) that are communicably coupled to the computer 502. Moreover, any or all parts of the API 512 or the service layer may be implemented as child or sub-modules of another software module, enterprise application, or hardware module without departing from the scope of this disclosure.

The computer 502 includes the interface 504. Although illustrated as a single interface, two or more interfaces may be used according to particular needs, desires, or particular implementations of the computer 502. The interface is used by the computer 502 for communicating with other systems in a distributed environment that are connected to the network 530. Generally, the interface includes logic encoded in software or hardware (or a combination of software and hardware) and operable to communicate with the network 530 or cloud. More specifically, the interface may include software supporting one or more communication protocols associated with communications such that the network or the hardware of the interface is operable to communicate physical signals within and outside of the illustrated computer.

The computer 502 includes at least one computer processor (e.g., computer processor 505). Although illustrated as a single computer processor, two or more processors may be used according to particular needs, desires, or particular implementations of the computer. Generally, the computer processor executes instructions and manipulates data to perform the operations of the computer and any algorithms, methods, functions, processes, flows, and procedures as described in the instant disclosure.

The computer 502 also includes a memory 506 that holds data for the computer 502 or other components (or a combination of both) that can be connected to the network 530. For example, memory 506 can be a database storing data consistent with this disclosure. Although illustrated as a single memory, two or more memories may be used according to particular needs, desires, or implementations of the computer 502 and the described functionality. While memory 506 is illustrated as an integral component of the computer 502, in alternative implementations, memory 506 can be external to the computer 502.

The application 507 is an algorithmic software engine providing functionality according to particular needs, desires, or implementations of the computer 502, particularly with respect to functionality described in this disclosure. For example, the application can serve as one or more components, modules, applications, etc. Further, although illustrated as a single application, the application may be implemented as multiple applications on the computer 502.

In addition, although illustrated as integral to the computer, in alternative implementations, the application can be external to the computer.

There may be any number of computers associated with, or external to, a computer system containing computer 502, each computer communicating over the network. Further, the term "client," "user," and other appropriate terminology may be used interchangeably as appropriate without departing from the scope of this disclosure. Moreover, this disclosure contemplates that many users may use one computer, or that one user may use multiple computers.

In some embodiments, the computer 502 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, a cloud computing system may operate according to one or more service models, such as infrastructure as a service (IaaS), platform as a service (PaaS), software as a service (SaaS), mobile "backend" as a service (MBaaS), artificial intelligence as a service (AIaaS), serverless computing, and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method, comprising:

operating a drilling operation, via a drilling system, to drill a first well path in a wellbore;

obtaining, via a plurality of sensors disposed in the drilling system, well path data describing the first well path through one or more formations of a subsurface, wherein the plurality of sensors comprise a mud property sensor and a drilling sensor;

obtaining, via the plurality of sensors, first acquired drilling parameter data in real-time during the drilling operation for a predetermined well, wherein the drilling operation corresponds to the first well path, wherein first acquired drilling parameter data comprises torque data, rate of penetration data, and formation density data;

determining, by a computer processor, first predicted drilling data using a machine-learning model based on the well path data and the first acquired drilling parameter data, wherein the machine-learning model comprises a similarity learning model comprising a Pearson correlation, k-nearest neighbor approach, wherein the first predicted drilling data comprises a predicted well path for the predetermined well;

determining, by the computer processor, that the first predicted drilling data fails to satisfy a predetermined criterion;

determining, by the computer processor and in response to determining that the first predicted drilling data fails to satisfy the predetermined criterion, an adjusted well path for the drilling operation, wherein the adjusted well path is different from the predicted well path;

transmitting, by the computer processor to the drilling system, a first command to update the drilling operation to implement the adjusted well path; and adjusting steering parameters of a bottom hole assembly in real-time, using the adjusted well path, to change a well trajectory of the drilling system, during the drilling operation.

2. The method of claim 1, wherein the first acquired drilling parameter data corresponds to the first well path of the drilling operation using the well path data, the method further comprising:

performing, by the computer processor using the machine-learning model, a comparison of the first acquired drilling parameter data with the predetermined criterion;

determining an actual correspondence-per-length as a result of the comparison;

determining a success factor based on the actual correspondence-per-length; and obtaining second well path data wherein the second well path data corresponds to a second well path of the drilling operation using the first predicted drilling data.

3. The method of claim 1, wherein the predetermined criterion comprises a planned correspondence-per-length of a first drilling run among a plurality of drilling runs in the first well path.

4. The method of claim 3, wherein determining the first predicted drilling data comprises:

processing the first acquired drilling parameter data, using the machine-learning model, to:

remove data outliers to form a first narrowed data, and remove highly-uncertain data sources to form a second narrowed data, determining, using the first narrowed data and the second narrowed data, a data consistency of the first acquired drilling parameter data with the planned correspondence-per-length;

determining, using the data consistency, a data source confidence; and estimating, using the data source confidence, a data source uncertainty.

5. The method of claim 1, further comprising:

obtaining historical well data for one or more wells at a predetermined distance from the predetermined well, training, by the computer processor using the machine-learning model, the similarity learning model to form a trained similarity model of the one or more wells to the predetermined well, wherein the training comprises similarities between the one or more wells and the predetermined well, and scaling, by the computer processor using the machine-learning model, the historical well data to determine the first predicted drilling data for the predetermined well, wherein the machine-learning model uses the historical well data to determine the predetermined criterion.

6. The method of claim 1, further comprising:

determining, based on the machine-learning model, third well path data using second acquired drilling parameter data that is obtained in real-time during the drilling operation; and transmitting, by the computer processor to the drilling system, a second command to terminate the drilling operation in response to determining that the third well path data fails to satisfy the predetermined criterion.

7. The method of claim 1, further comprising:

determining, based on the machine-learning model, third well path data using second acquired drilling parameter data that is obtained in real-time during the drilling operation;

determining an adjusted drilling parameter based on the second acquired drilling parameter data, the well path data, and the third well path data; and transmitting, by the computer processor to the drilling system, a second command to adjust the drilling operation based on the adjusted drilling parameter.

8. The method of claim 1, further comprising:

entering the well path data into a control system for the drilling operation, and wherein the first acquired drilling parameter data is determined using the machine-learning model and the well path data, wherein the first predicted drilling data comprises weighing a drilling parameter importance of the well path data.

9. The method of claim 1, further comprising:

obtaining, from the machine-learning model, the first predicted drilling data for the drilling operation, and wherein the first predicted drilling data is determined using the machine-learning model and the first acquired drilling parameter data;

wherein the first predicted drilling data comprises a success factor of the well path data.

10. The method of claim 1, wherein the machine-learning model comprises an artificial neural network comprising an input layer, a plurality of hidden layers, and an output layer;

wherein the similarity learning model analyzes and processes the first acquired drilling parameter data using the machine-learning model; and wherein the first acquired drilling parameter data comprises geosteering data.

11. A system, comprising:

a drilling system comprising a plurality of sensors and a drill string comprising a drill bit, wherein the drilling system is coupled to a wellbore, the plurality of sensors comprising a mud property sensor and a drilling sensor; and a control system coupled to the drilling system, wherein the control system comprises a computer processor, the control system comprising functionality for:

operating a drilling operation, via the drilling system, to drill a first well path in the wellbore;

obtaining, via the plurality of sensors, well path data describing the first well path through one or more formations through a subsurface;

obtaining, via the plurality of sensors, first acquired drilling parameter data in real-time during the drilling operation for a predetermined well, wherein the drilling operation corresponds to the first well path associated with the wellbore, wherein first acquired drilling parameter data comprises torque data, rate of penetration data, and formation density data;

determining, using the computer processor, first predicted drilling data using a machine-learning model based on the well path data and the first acquired drilling parameter data, wherein the machine-learning model comprises a similarity learning model comprising a Pearson correlation, k-nearest neighbor approach;

wherein the first predicted drilling data comprises a predicted well path for the predetermined well;

determining, by the computer processor, that the first predicted drilling data fails to satisfy a predetermined criterion;

determining, by the computer processor and in response to determining that the first predicted drilling data fails to satisfy the predetermined criterion, an adjusted well path for the drilling operation, wherein the adjusted well path is different from the predicted well path;

transmitting, by the computer processor to the drilling system, a first command to update the drilling operation to implement the adjusted well path; and adjusting steering parameters of a bottom hole assembly in real-time, using the adjusted well path, to change a well trajectory of the drilling system, during the drilling operation.

12. The system of claim 11, further comprising:

a user device coupled to the control system, wherein the user device is configured to provide a graphical user interface for presenting the first predicted drilling data.

13. The system of claim 12, wherein the predetermined criterion comprises a planned correspondence-per-length of a first drilling run among a plurality of drilling runs in the first well path, wherein the user device is further configured to:

present the first predicted drilling data fails to satisfy the planned correspondence-per-length, and obtain a user selection of one or more adjusted well paths in response to presenting the first predicted drilling data fails to satisfy the planned correspondence-per-length.

14. The system of claim 11, wherein the control system is further configured to:

obtain historical well data for one or more wells at a predetermined distance from the predetermined well, perform training, by the computer processor using the machine-learning model, the similarity learning model to form a trained similarity model of the one or more wells to the predetermined well, wherein the training comprises similarities between the one or more wells and the predetermined well, and scale, by the computer processor using the machine-learning model, the historical well data to determine the first predicted drilling data for the predetermined well, wherein the machine-learning model uses the historical well data to determine the predetermined criterion.

15. The system of claim 11, wherein the control system is further configured to:

determine, based on the machine-learning model, third well path data using second acquired drilling parameter data that is obtained in real-time during the drilling operation; and transmit, by the computer processor to the drilling system, a second command to terminate the drilling operation in response to determining that the third well path data fails to satisfy the predetermined criterion.

16. The system of claim 11, wherein the control system is further configured to:

determine, based on the machine-learning model, third well path data using second acquired drilling parameter data that is obtained in real-time during the drilling operation;

determine, based on the second acquired drilling parameter data, the well path data, and the third well path data, an adjusted drilling parameter; and transmit, by the computer processor to the drilling system, a second command to adjust the drilling operation based on the adjusted drilling parameter.

17. The system of claim 11, wherein the control system is further configured to:

obtain the well path data entered for the drilling operation, and wherein the first acquired drilling parameter data is determined using the machine-learning model and the well path data, wherein the first predicted drilling data comprises weighing a drilling parameter importance of the well path data.

18. The system of claim 11, wherein the control system is further configured to:

obtain, using the machine-learning model, the first predicted drilling data for the drilling operation, wherein the first predicted drilling data is determined using the machine-learning model and the first acquired drilling parameter data, wherein the first predicted drilling data comprises a success factor of the well path data.

19. The system of claim 11, wherein the machine-learning model comprises:

an artificial neural network comprising an input layer, a plurality of hidden layers, and an output layer; and wherein the similarity learning model analyzes and processes the first acquired drilling parameter data using the machine-learning model;

wherein the first acquired drilling parameter data comprises geosteering data.

20. The system of claim 11, wherein the drilling system comprises a coiled tubing drilling system; and the drilling operation comprises an underbalanced drilling operation.

* * * * *